United States Patent [19]

Todd

[11] 4,129,249

[45] Dec. 12, 1978

[54] CENTRIFUGE FOR SEPARATING SOLIDS AND LIQUIDS

[75] Inventor: David B. Todd, Saginaw, Mich.

[73] Assignee: Baker Perkins Inc., Saginaw, Mich.

[21] Appl. No.: 825,258

[22] Filed: Aug. 17, 1977

[51] Int. Cl.[2] ..... B04B 1/20; B04B 9/10

[52] U.S. Cl. ..... 233/7; 233/24; 310/105; 192/58 A

[58] Field of Search ..... 233/7, 23 R, 24; 60/347, 330; 192/58 R, 58 A; 310/105, 93

[56] References Cited

U.S. PATENT DOCUMENTS

| | | | |
|---|---|---|---|
| 1,653,360 | 12/1927 | Howard | 192/58 A |
| 2,342,414 | 2/1944 | Magill | 192/58 A |
| 2,557,799 | 6/1951 | Salmivuori | 192/58 A |
| 3,151,444 | 10/1964 | Jonkers et al. | 60/347 |
| 3,566,168 | 2/1971 | Matsubara | 310/105 |
| 3,784,852 | 1/1974 | Noly | 310/105 |
| 3,838,323 | 9/1974 | Anderson | 310/105 X |
| 3,923,241 | 12/1975 | Cyphelly | 233/7 |
| 3,999,385 | 12/1976 | Hoeller et al. | 60/347 |

FOREIGN PATENT DOCUMENTS

| | | | |
|---|---|---|---|
| 1175498 | 8/1964 | Fed. Rep. of Germany | 60/347 |

*Primary Examiner*—George H. Krizmanich

*Attorney, Agent, or Firm*—Learman & McCulloch

[57] ABSTRACT

A bowl type centrifuge for separating solids and liquids from mixtures in which the rotary differential speed between the centrifuge bowl and an internal conveying scroll is established by variably augmenting the frictional torque imparted to the bowl by the mixture driven in rotation by the scroll. The scroll is directly driven in rotation by a drive motor. The mixture to be separated is in turn driven in rotation by the rotating scroll and the frictional drag between the rotating mixture and the inner surface of the bowl induces rotation of the bowl. The speed of rotation of the bowl thus induced is less than that of the scroll, thus creating a rotary speed differential which enables the scroll to convey solid particles of the mixture axially toward one end of the bowl. The magnitude of this rotary speed differential is adjusted by a variable torque drive coupling between the scroll and bowl which may take the form of a variable speed fluid drive or an eddy current coupling to variably augment the torque transmitted to the bowl by the rotating mixture.

4 Claims, 2 Drawing Figures

CENTRIFUGE FOR SEPARATING SOLIDS AND LIQUIDS

BACKGROUND OF THE INVENTION

Figures 1, 2:
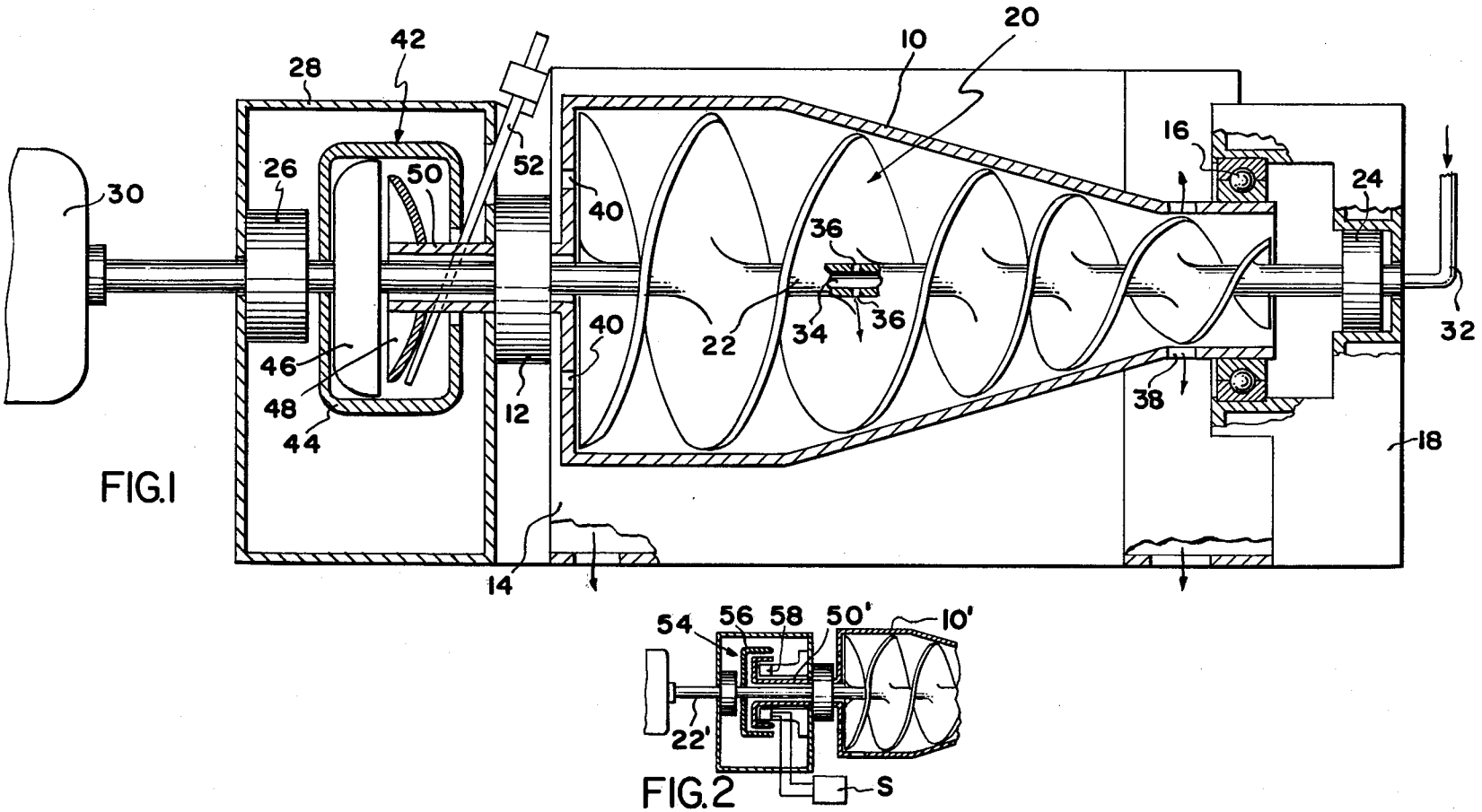

Centrifuges of the type wherein a helical conveying scroll is mounted within a frustoconical centrifuge bowl to separate solids and liquids from liquid-solid mixtures are well known. In devices of this type, a rotary speed differential is established between the rotating bowl and the internal conveying scroll so that rotation of the helical scroll relative to the bowl can drive the solid components of the mixture to one end of the bowl where they are extracted. Typically, such devices establish the rotary speed differential by means of a gear box. In addition to being a high maintenance item, the gear boxes employed do not permit any variation in differential speed between the scroll and bowl and this lack of capability of varying the differential speed produces a reduction in separating efficiency in the face of variations in the consistency of material being fed into the centrifuge.

While various attempts have been made to provide a speed differential adjustment capability, — see for example U.S. Pat. Nos. 3,734,399 and 3,923,241 — these attempts have involved the addition of fluid pumps and variable speed regulating mechanisms which are not only expensive, but do not provide any substantial advantage insofar as maintenance costs are concerned over the conventional gear box.

SUMMARY OF THE INVENTION

In accordance with the present invention, the creation of a rotary speed differential between the scroll and centrifuge bowl is accomplished by using the mixture being separated as a "drive coupling" between the scroll and the bowl. In an apparatus embodying the present invention, the scroll is directly driven in rotation by a drive motor. Rotation of the bowl is induced by the frictional drag exerted on the bowl by the mixture being separated which is itself driven in rotation by the rotating scroll. The normal "slippage" inherent in this type of "drive coupling" results in the scroll being driven at a constant rotary speed by the drive motor and finds, under steady state conditions, the bowl rotating at a lesser speed of rotation due to the "slippage".

To provide the capability of adjusting or varying this speed differential, a drive coupling is connected between the scroll shaft and bowl. The drive coupling employed — a fluid drive or an eddy current coupling — is provided with a control by means of which the torque transmission capabilities of the drive can be varied or adjusted. By increasing the proportion of the torque transmitted by the drive medium, the degree of "slippage" between the scroll and the bowl via the mixture can be reduced. In essence, the torque transmission characteristics of the drive medium may be varied to variably augment the torque transmitted from the scroll to the bowl via the rotating mixture.

Other objects and features of the invention will become apparent by reference to the following specification and to the drawings.

IN THE DRAWINGS

FIG. 1 is a detail cross sectional view of a centrifuge embodying the invention; and FIG. 2 is a partial cross sectional view of a modified form of the invention.

THE CENTRIFUGE

A centrifuge embodying the present invention includes a hollow frustoconical centrifuge bowl designated generally 10 which is supported at its opposite ends for rotation about a generally horizontal axis as by a bearing 12 mounted in a centrifuge housing 14 and a bearing 16 mounted in an end stand 18. A helical conveying scroll designated generally 20 is mounted within bowl 10 for rotation coaxially within the bowl, the scroll 20 including a central shaft 22 rotatably supported by a bearing 24 in end stand 18 and a bearing 26 mounted in drive housing 28. A drive motor, schematically illustrated at 30, is connected directly to scroll shaft 22 to drive the scroll in rotation within bowl 10.

A liquid-solid mixture which is to be separated by the centrifuge is fed into the interior of bowl 10 through an infeed tube 32 which projects coaxially into a central bore 34 in shaft 22. The incoming mixture passes from the interior of shaft 22 into the bowl via radially extending ports 36 which communicate with bore 34 in shaft 22.

During operation of the centrifuge, the solid-liquid mixture which is fed into the interior of bowl 10 is subjected to a centrifuging action by the rotation of bowl 10. Scroll 20, by means to be described below, is driven in rotation at a rotary speed greater than the rotary speed of the bowl, and this rotary speed differential enables the helical scroll to feed the solid portion of the mixture toward the right-hand end of the rotating bowl in a well known manner to discharge the solids through openings 38 at the right-hand or small diameter end of the generally conical bowl. The liquid component of the mixture tends to collect at the large diameter or left-hand end of the bowl and is discharged from the bowl via liquid discharge openings 40.

As stated above, drive motor 30 is directly connected to shaft 22 of scroll 20, and provides a positive rotary drive to the scroll.

Bowl 10 has no direct connection to motor 30. Rotation of bowl 10 is induced primarily by scroll 20 which, when rotated, induces a rotary component in the solid-liquid mixture being separated, and the frictional drag of this rotating mixture in turn imparts rotation to bowl 10. Because the rotary coupling between scroll 20 and bowl 10 via the mixture being separated is not a positive coupling and because of several other physical factors, under steady state conditions the bowl 10 will not rotate as fast as scroll 20, thus creating a normal rotary speed differential between the bowl and scroll, because the efficiency of the "drive coupling" provided by the mixture is substantially less than 100%. For purposes of explanation, it may be considered that there is always some degree of slippage between the scroll and bowl. This degree of slippage is determined by several factors, such as the geometry of the scroll and bowl shapes and will, of course, be dependent upon the physical properties of the mixture being separated.

Because the degree of slippage or the steady state rotary speed differential between the scroll and bowl does depend on variable factors, it is desirable to provide the apparatus with a capability of exerting some degree of control or adjustment of the rotary speed differential between the scroll and bowl. This is accomplished by a fluid drive coupling designated generably 42 which is coupled between scroll shaft 22 and bowl 10 to transmit a selected portion of the rotary torque of shaft 22 to bowl 10. The fluid drive coupling 42 shown in the drawings is a modified form of a type VS Class 2, Gyrol Fluid Drive manufactured by American Blower Corporation of Detroit, Mich. The type VS drive includes a casing 44 provided with a series of impeller blades 46 on its input shaft which, in the present instance, has been replaced by shaft 22. A runner 48 mounted upon a hollow shaft 50 (which replaces the standard output shaft of the commercial coupling) coupled directly to bowl 10 is located in the casing of fluid drive 42 so that oil driven in rotation by the rotating impeller impinges on the blades of the runner to drive the runner in rotation. A scoop tube 52 projects into the casing and is adjustable in a direction longitudinally of the tube to control the depth of the annular band of oil within the casing to thus vary the amount of torque transmitted by the rotating band of oil from impeller 44 to runner 48.

The rotary torque transmitted to bowl 10 via fluid 42 augments the rotary torque transmitted to bowl 10 by the rotation scroll 20 via the mixture within bowl 10. By adjustably controlling the amount of torque transmitted to the bowl via fluid drive 42, the rotary speed differential between bowl 10 and scroll 20 may be adjusted within the range which extends from a maximum speed differential when substantially no torque is being transmitted to the bowl via fluid drive 42 to a minimum speed differential (when the bowl and scroll rotate at substantially the same speed) represented by the situation where the fluid drive contains a maximum depth of oil to provide a maximum torque transmission.

In FIG. 2 a modified form of the invention is disclosed in which the variable torque fluid drive coupling 42 of the FIG. 1 embodiment has been replaced by an eddy current coupling designated generally 54. Coupling 54 includes an inducter drum 56 fixedly mounted upon and rotatable with scroll shaft 22', and a field pole piece member 58 fixedly mounted upon and rotatable with the hollow shaft 50' which is integral with the bowl 10'. A stationary toroidal field coil 58 is electrically connected to a variable electric power supply S which is operable to vary the magnetic field generated by the coil. Commercially available eddy current couplings and controllers may be adapted, by modification to the standard shafting as described above, for use in the form disclosed. By varying the magnetic field of coil 58, the degree of coupling between scroll shaft 22' and bowl 10' may be varied.

While two embodiments of the invention have been described in detail, it will be apparent to those skilled in the art that the disclosed embodiments may be modified. Therefore, the foregoing description is to be considered to be exemplary rather than limiting, and the true scope of the invention is that defined in the following claims.

What is claimed is:

1. In a centrifuge for separating the liquid and solid components of a liquid-solid mixture, said centrifuge having a centrifuge bowl mounted for rotation about its axis, a helical conveying scroll mounted within said bowl for coaxial rotation relative to said bowl, and drive means for driving said bowl and said scroll in rotation at a speed differential relative to each other such that solids in said bowl are conveyed by said scroll to one end of said bowl; the improvement wherein said drive means comprises a power driven input shaft directly connected to said scroll for driving said scroll in rotation and for imparting rotation to said bowl via the frictional drag exerted on said bowl by the liquid-solid mixture in said bowl driven in rotation by said scroll, and control means for transmitting a selected component of the rotary torque of said shaft to said bowl to adjust the rotary speed of said bowl relative to said scroll.

2. The invention defined in claim 1 wherein said control means comprises a fluid drive means coupled between said shaft and said bowl operable to variably augment the rotary torque applied to said bowl by the frictional drag of the rotating mixture.

3. The invention defined in claim 2 wherein said fluid coupling means comprises an impeller mounted on said shaft for rotation therewith, a runner coupled to said bowl for rotation therewith, a fluid containing casing enclosing said impeller and said runner for constraining fluid driven in rotation by said impeller to drive said runner in rotation, and control means for selectively varying the amount of fluid within said casing to thereby vary the torque transmitted by said fluid from said impeller to said runner.

4. The invention defined in claim 1 wherein said control means comprises an eddy current coupling coupled between said shaft and said bowl operable to variably augment the rotary torque applied to said bowl by the frictional drag of the rotating mixture.

* * * * *